US011866251B2

(12) United States Patent
Mirzoyan et al.

(10) Patent No.: US 11,866,251 B2
(45) Date of Patent: Jan. 9, 2024

(54) SEAL FOR COVER ON WASTEWATER TREATMENT TANK

(71) Applicant: Ovivo Inc., Montreal (CA)

(72) Inventors: Artak Daviti Mirzoyan, Eagle Mountain, UT (US); Haydon Christiansen, Sandy, UT (US); Eric Hunter, North Salt Lake, UT (US)

(73) Assignee: Ovivo Inc., Montreal (CA)

( * ) Notice: Subject to any disclaimer, the term of this patent is extended or adjusted under 35 U.S.C. 154(b) by 0 days.

(21) Appl. No.: 17/733,597

(22) Filed: Apr. 29, 2022

(65) Prior Publication Data

US 2022/0356007 A1 Nov. 10, 2022

Related U.S. Application Data

(60) Provisional application No. 63/185,236, filed on May 6, 2021.

(51) Int. Cl.
*B65D 90/54* (2006.01)
*E04H 7/06* (2006.01)
*B65D 90/08* (2006.01)

(52) U.S. Cl.
CPC ..... *B65D 90/54* (2013.01); *B65D 90/08* (2013.01); *E04H 7/065* (2013.01)

(58) Field of Classification Search
CPC ..... E04H 9/024; E04H 7/065; B65D 90/66; B65D 90/64; B65D 90/626; B65D 90/623; B65D 90/62; B65D 90/60; B65D 90/587; B65D 90/585; B65D 90/582; B65D 90/58; B65D 90/56; B65D 90/545; B65D 90/54; B65D 90/08
See application file for complete search history.

(56) References Cited

U.S. PATENT DOCUMENTS 5,878,907 A * 3/1999 Graf ..... B65D 11/06 220/4.24
6,280,614 B1 * 8/2001 Berg ..... B01D 21/0042 210/232
7,572,372 B2 * 8/2009 Graf ..... B65D 88/06 220/4.24
7,854,338 B2 * 12/2010 Graf ..... B29C 65/7802 220/4.07
8,070,005 B1 * 12/2011 Kruger ..... E03F 11/00 220/670
8,740,005 B1 * 6/2014 Holbrook ..... B65D 90/08 220/4.16
10,513,677 B2 * 12/2019 Alumbaugh ..... C12M 41/00
2005/0285407 A1 * 12/2005 Davis ..... F03B 3/128 290/54

(Continued)

*Primary Examiner* — Kareen K Thomas
(74) *Attorney, Agent, or Firm* — Thomas M. Freiburger

(57) ABSTRACT

A sealing system for a covered tank, particularly a fixed gas-sealing tank in a wastewater treatment system, includes a thrust ring positioned just inside the tank rim, secured to a series of radial beams for the cover. Preferably supported on corbels anchored to the interior tank wall, the thrust ring has an outwardly extending generally horizontal flange that overlies the edge of the tank rim. To this flange and to the top of the tank rim is secured a flexible membrane seal, around the periphery of the tank. The membrane seal is easily installed, reliable as a seal, and can be efficiently replaced when needed.

14 Claims, 3 Drawing Sheets

(56) References Cited

U.S. PATENT DOCUMENTS

| | | | | |
|---|---|---|---|---|
| 2009/0051239 | A1* | 2/2009 | Kinoshita | H02K 53/00 310/152 |
| 2009/0084223 | A1* | 4/2009 | Harrup | F16H 48/08 74/606 R |
| 2011/0284095 | A1* | 11/2011 | Vauchel | B64D 29/06 137/15.1 |
| 2011/0293371 | A1* | 12/2011 | Moore, Jr. | E03F 1/003 405/49 |
| 2012/0213641 | A1* | 8/2012 | Lin | F03G 7/00 416/227 R |

* cited by examiner

SEAL FOR COVER ON WASTEWATER TREATMENT TANK

This application claims benefit of provisional application Ser. No. 63/185,236, filed May 6, 2021.

BACKGROUND OF THE INVENTION

This invention concerns wastewater treatment plants, and in particular tanks that are covered to contain gases and odors, often containing pressure within the tank and requiring a seal.

In municipal sewage treatment plants, there is a need for gas sealing to build pressure and control odors within various types of tanks. This is typically done using a steel cover with a perimeter side sheet, spaced slightly inwardly from the tank wall and extending vertically down several feet, sometimes three feet or more, to create a water seal. In the case of a fixed cover, an annular seal (usually composed of polyethylene foam or asphalt, tar and sand) has been used to seal the space between the cover side sheet and tank wall.

Disadvantages of this type of seal are the expense of providing and structurally supporting the cover side sheet, the need for the conventional seal materials noted above, and difficult installation of such a seal system. In addition, such a seal requires strong, structure-supporting anchor bolts into the top of a concrete tank wall, raising strength considerations and requiring grout filling in the case of an older wall or one with an inconsistent-level top surface.

SUMMARY OF THE INVENTION

The current invention eliminates the need for a cover side sheet as described above and for the conventional annular seal applied between side sheet and tank wall. Instead, a thrust ring, which supports and bears the outward and downward forces of a series of radial beams supporting the cover, is secured on or adjacent to the rim of a concrete tank. The thrust ring may be any type of structural member, and has a flange extending radially outwardly so as to be positioned close to the tank rim and preferably overhanging the rim closely. A section of flexible sheet sealing material, such as PVC coated flexible membrane material, is mechanically connected to the tank rim or wall and to the flange, forming a seal at both connections, extending around the periphery of the tank. The flange of the thrust ring preferably overhangs the rim of the tank wall, or comes very close to the rim, so that the membrane material cannot be sucked down into a gap between the two, as well as for safety considerations. This provides a simple and reliable seal, an effective flexible seal with easy installation and ease of future replacement without draining or lowering the level of the tank.

In one preferred embodiment the thrust ring is seated and secured on and bears against a series of corbels anchored into the interior face of the concrete tank wall. These corbels can be at spacing of about eight feet or less around a circular tank, for example. The thrust ring may be bolted to the corbels and seated thereon with a Teflon (or other material) slide plate below the thrust ring, providing for sliding movement with expansion/contraction. In this embodiment the flange of the thrust ring extends outwardly, generally horizontally from the top of the thrust ring and preferably overhangs the tank rim by a small distance, i.e. an inch or two. The flexible membrane seal is held against the tank rim and against the top surface of the flange by compression using bars bolted to the tank rim and to the flange.

It is an object of the invention to provide a simpler, more cost-effective, functionally effective and efficient seal system for tank covers intended to retain gases, including pressurized gases. Other advantages and features of the invention will be apparent from the following description of preferred embodiments.

DESCRIPTION OF PREFERRED EMBODIMENTS

Figure 1:
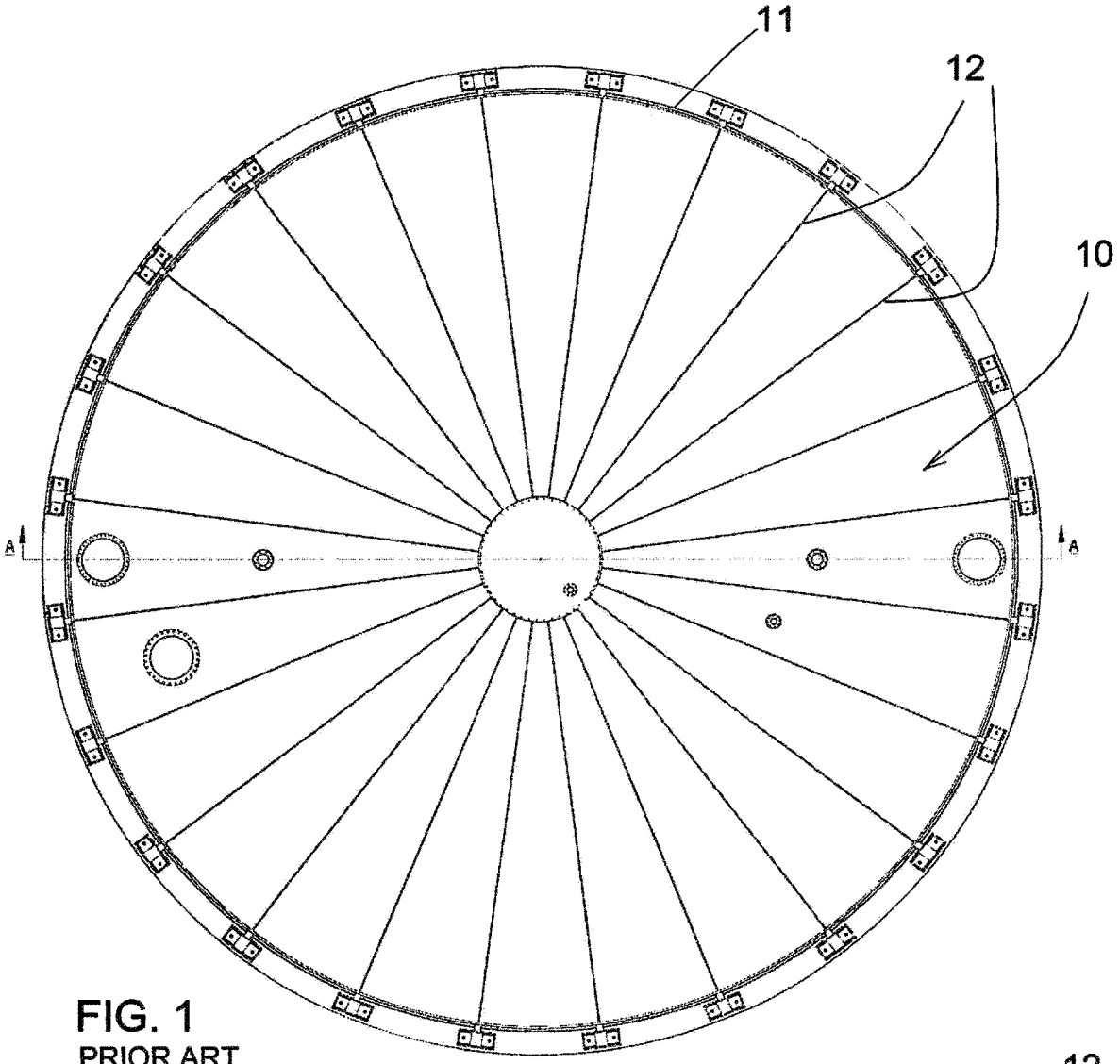
FIG. 1 PRIOR ART
FIGS. 1 and 2 are plan and elevation views showing a fixed cover for a wastewater treatment tank, in accordance with prior art.

FIG. 1 is a plan view showing a fixed cover 10 for a tank, such as a sewage treatment tank. The cover has a conventional form of gas seal with the tank, not shown in the drawing.

Figure 2:
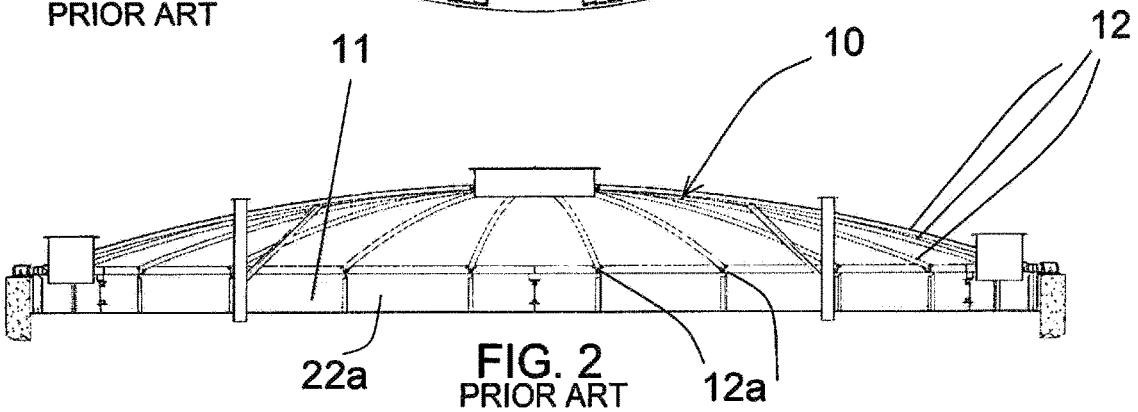
FIG. 2 PRIOR ART

FIGS. 1 and 2 indicate that the fixed cover 10 preferably is of sheet steel 11 supported by a series of radial beams indicated at 12. Other plate or sheet material is possible for the cover material 11. Ends of the radial beams are indicated at 12*a* in FIG. 2. There may be, for example, thirty-six of these radial beams as shown in the drawings, spaced at 10° between beams, or twenty-four of the beams spaced at 15°, or any other number of beams sufficient to support the metal cover 11 used. FIG. 2 also shows other structures typical of a gas-sealed cover but not necessarily involved in the invention.

Figure 3:
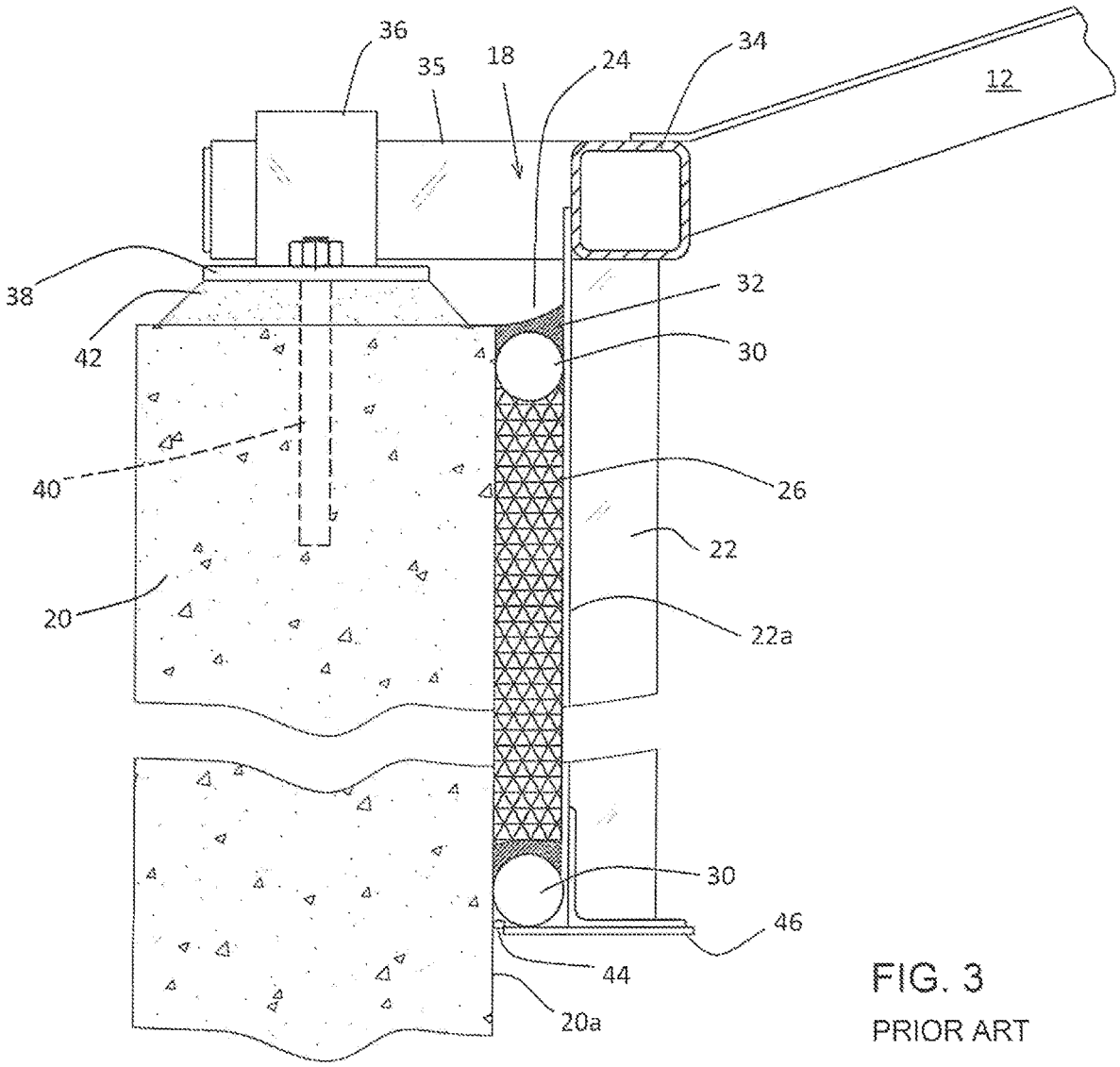
FIG. 3 PRIOR ART
FIG. 3 is a sectional elevation view showing a prior art system for sealing a tank cover to a tank wall or rim.

In FIG. 3 an example is shown of a liquid and gas seal indicated generally as 18 in a conventional implementation. The tank wall, typically of concrete, is shown at 20. One of the radial cover beams 12 is seen in the drawings. In the illustrated sealing system, a side sheet 22, with a cylindrical wall 22*a*, is in a position spaced away a short distance from the inner side 20*a* of the tank wall 20. This distance can be, for example, approximately two inches. This creates a space 24 continuous around the periphery of the tank.

Within the space 24 is a sealant 26. In typical installations the sealant 26 has been expanding polyurethane foam, chemical grout, CRAFTCO, ROADSAVER, a polymer-modified asphalt, etc. As illustrated, backer rods 30 can be included at top and bottom against the filler sealant material 26. Above each of the backer rods a further sealant may be used, mainly top and bottom sealants 32. These can be, for example, SIKAFLEX, Dow Corning 790, silicone, SONALASTIC, or other appropriate sealants.

In this prior art installation, the numerous radial beams 12 are secured at their outer ends to a thrust ring 34, e.g. by welding and/or bolts or other means, in a sealed connection. The thrust ring 34 typically has been a box beam, as shown. The box beam in turn is secured to a cantilevered cover support arm 35 that extends radially from the wall 20 to the thrust ring 34, occurring typically at each of the radial beams 12. The cantilevered cover support arm or beam 35 is retained in position by a wall stirrup 36, typically an inverted U-shaped stirrup that has a bottom plate 38 which, in turn, is secured down to the top of the tank wall 20 using anchor bolts such as shown at 40. Such an installation nearly always required use of a grout 42 to produce a uniform, consistent, even surface for the series of wall stirrups and cover support beams.

As can be seen from FIG. 3, the side sheet 22 is suspended from the thrust ring/cover support arm structure 34, 35. There is no securement to the inner side of the wall. This assembly may require further sealant at 44, at the bottom of the side sheet structure, at a position where the bottom seal plate 46 is secured to the side sheet.

The liquid/gas seal assembly shown in FIG. 3, typically used in sewage treatment tanks that require gas containment, is complex, costly and difficult to install and maintain. Seal material replacement, which is required after a period of time, is difficult and inefficient. In addition, variations in the liquid level can cause a problem in that if gas escapes it can cause deterioration of the sealing material and rust at the side sheet 22.

Figure 4:
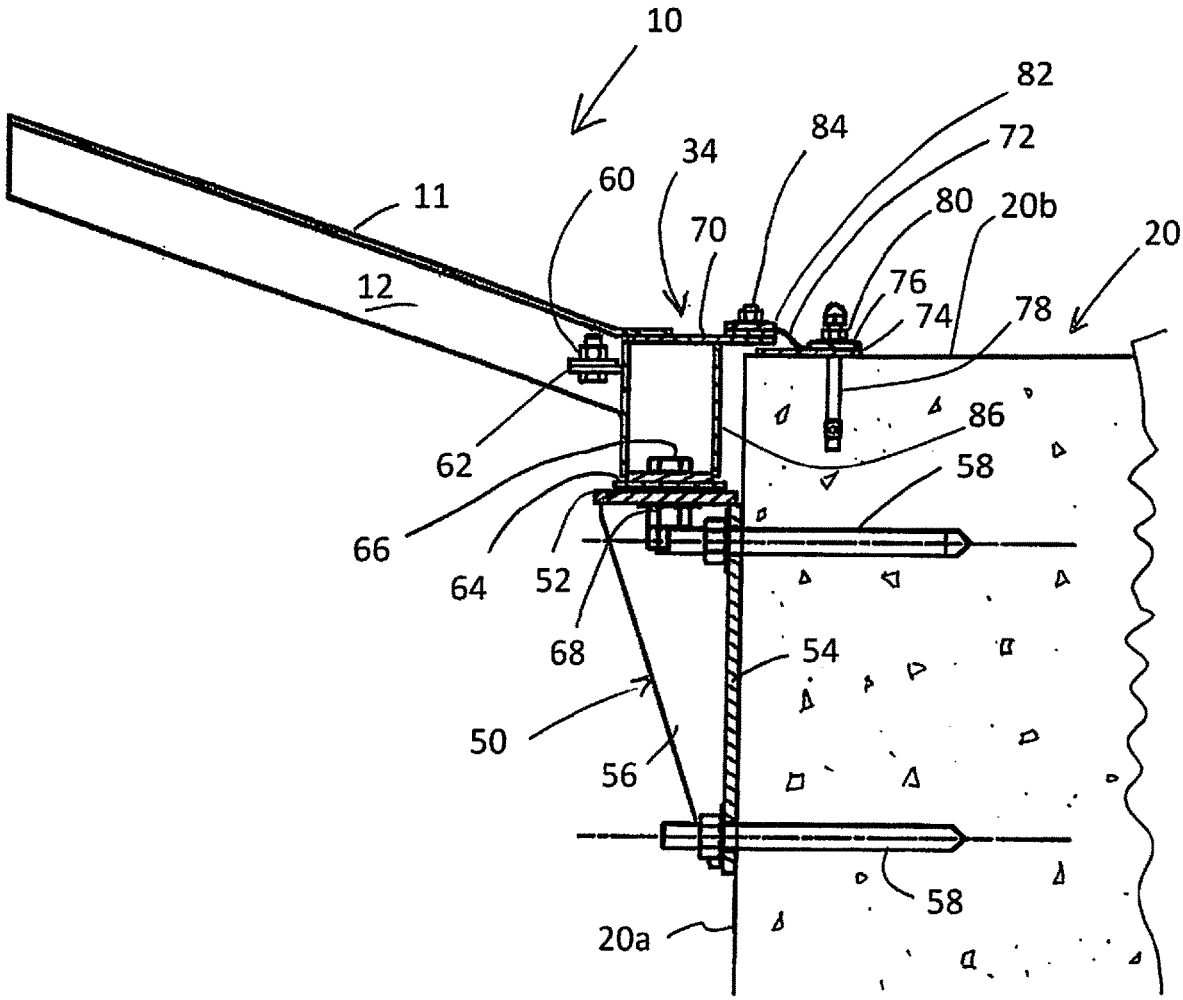
FIG. 4 is a sectional elevation view showing a sealing arrangement of the invention.

An improved gas seal assembly in accordance with the invention is shown in FIG. 4. Eliminating the need for a side sheet, the invention carries the thrust ring on a series of corbels 50 secured to the interior side of the tank wall 20. The corbels 50 can be less frequent than the radial beams 12, occurring at, for example, 20° to 30° separation. The corbels could occur at each radial beam; this depends on design of components.

Each corbel 50 has a horizontal structural support plate 52 as an upper corbel surface, welded to a vertical flange 54, with a triangular gusset plate 56 as shown. Each is secured into the concrete tank wall by anchor bolts 58. The series of corbels support the thrust ring 34, which can be a structural beam of any suitable cross section, shown as a box beam or fabricated box beam, secured to the radial beams 12 and to the cover sheet steel 11 in sealed relationship. FIG. 4 shows the radial beam ends can be affixed to the thrust ring 34 by welding. Erection tabs 62 with bolts 60 can be used to aid in erection. All adjoining surfaces, where needed, are sealed with gas tight seals, particularly the cover sheet 11 connection to the thrust ring 34.

The thrust ring 34 is permitted some radial movement on the support plate 52, for accommodating thermal expansion and contraction and outward thrust forces. For this purpose a slide plate 64 is positioned between the thrust ring and the support plate 52. The slide plate can be, for example, FLUORGOLD or TEFLON or another low-friction sheet material. In the embodiment shown a bolt 66 extends from the thrust ring 34 down through a slotted hole in the support plate 52 (a slotted hole can be on either or both of these components), secured by a nut 68 below the support plate 52. The bolt 66 can be welded in place, thus providing threaded studs that extend downwardly. Alternatively, bolt studs can simply be welded onto the bottom side of a fabricated or "rolled" box beam as the thrust ring 34. The thrust ring 34 can be fabricated from several plates, such as shown in FIG. 4, allowing the bolts or studs 66 to be put in place.

In addition, the thrust ring 34 includes a thrust ring top plate 70 that overhangs from the remainder of the thrust ring in the radially outward direction, as shown. This extended part of the plate 70 continues around the tank, and provides a flange for gas-sealing the cover structure to the concrete wall 20. As seen in the drawing, a membrane seal 72, continuous (or with overlaps in sealed relationship) around the periphery of the tank, connects to the overhanging flange 70 and to the top surface 20*b* of the tank wall. Against that surface 20*b*, which may be rough or irregular, is positioned a gasket 74 capable of providing a seal against the surface. A clamp bar 76 presses the gasket down against the concrete, and this is held tight by a mechanical anchor 78 with threads and a nut 80 just above the clamp bar. The anchors 78 can occur as frequently as needed around the tank's periphery.

At the thrust ring the membrane seal 72 is firmly clamped in sealed relationship between the overhang flange of the top plate 70 and a clamp bar 82, secured with a nut 84 as shown. The clamp bars 76 and 82 can be arcuate and in sections, serially around the tank.

Note that the flange 70 extending close to the top of the tank wall need not be an extension of a top plate of the thrust ring. It could extend from elsewhere on the thrust ring, or the fastener end nut 84, clamp bar 82 and outer end of the membrane seal 72 could even be secured to the outer vertical wall 86 of the box beam. The flange could be eliminated, with the seal 72 secured directly to the thrust ring if desired, but the flange is preferred so as to avoid any substantial gap between thrust ring and tank rim.

Another variation is that the flexible membrane seal 72 could be secured directly to the cover sheet steel 11 in sealed relationship, rather than to the flange 70, which is an indirect sealed connection to the cover.

In this way, the invention provides a seal that is flexible, allowing for movement due to expansion of the steel tank cover and beams 12, and efficiently seals the entire periphery between the tank cover and the concrete tank wall. The seal does not rely on compression and expansion of a sealant mass to accommodate temperature changes, as in the typical prior sealing scheme. If repair or replacement of the membrane seal is required, this is a relatively simple operation involving mechanical connections and the positioning and securing of a new membrane.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. A rim seal connected between a cover and a concrete tank in a sewage treatment facility, comprising:

a concrete tank rim at periphery of the tank, and a tank cover over an interior of the tank, the tank cover being supported on the tank rim, a series of radial beams converging and extending angularly upwardly toward a top center of the tank cover, and supporting the tank cover, the radial beams having lower, outer ends terminating near the tank rim, a structural thrust ring around the periphery of the concrete tank, positioned adjacent to the tank rim and connected to the tank rim, the thrust ring being connected to the outer ends of the radial beams and being positioned to withstand outward forces from the radial beams, and a flexible membrane mechanically connected in sealed relationship to both the tank cover and the tank rim, thus providing a gas seal between the tank cover and the tank rim while allowing for thermal expansion and contraction.

2. The rim seal of claim 1, wherein the flexible membrane is connected in sealed relationship to the thrust ring and the thrust ring is connected in sealed relationship to the tank cover.

3. The rim seal of claim 2, wherein the thrust ring includes a flange extending radially outwardly over a horizontal portion of the tank rim, the flexible membrane being connected in sealed relationship to the flange.

4. The rim seal of claim 3, wherein the thrust ring has a top plate including said flange extending radially outwardly.

5. The rim seal of claim 3, wherein the thrust ring comprises a structural steel beam.

6. The rim seal of claim 5, wherein the thrust ring comprises a box beam.

7. The rim seal of claim 1, wherein the thrust ring is positioned inward of the concrete tank rim.

8. The rim seal of claim 1, including a series of support corbels secured to an interior side of the concrete tank rim, secured into the concrete, the corbels providing an upper corbel surface on which the thrust ring is supported.

9. The rim seal of claim 8, including said support corbels at 3° increments around the tank.

10. The rim seal of claim 8, including a said support corbel at each radial beam around the tank.

11. The rim seal of claim 8, wherein the corbels are secured with anchor bolts to said interior side of the concrete tank rim.

12. The rim seal of claim 8, wherein the thrust ring is secured to the corbels by bolts but allowing for thermal expansion movement of the thrust ring on the upper corbel surfaces, and with a slide plate positioned between the thrust ring and each corbel upper surface.

13. The rim seal of claim 1, wherein each radial beam has an erection tab near the radially outer end of the radial beam, and the erection tab being secured by bolting to a mating erection tab extending from the thrust ring.

14. The rim seal of claim 1, wherein the tank cover comprises sheet metal secured to the radial beams, the sheet metal extending over and against a top surface of the thrust ring in a sealed connection.

* * * * *